US008162067B2

(12) United States Patent
Ring et al.

(10) Patent No.: US 8,162,067 B2
(45) Date of Patent: Apr. 24, 2012

(54) SYSTEM AND METHOD TO EXPAND TUBULARS BELOW RESTRICTIONS

(75) Inventors: Lev Ring, Houston, TX (US); Varadaraju Gandikota, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 316 days.

(21) Appl. No.: 12/429,823

(22) Filed: Apr. 24, 2009

(65) Prior Publication Data

US 2010/0270035 A1 Oct. 28, 2010

(51) Int. Cl.
*E21B 17/00* (2006.01)
*E21B 43/00* (2006.01)

(52) U.S. Cl. ..... 166/384; 166/207

(58) Field of Classification Search ..... 166/207, 166/380, 384

See application file for complete search history.

(56) References Cited

U.S. PATENT DOCUMENTS

| | | | | |
|---|---|---|---|---|
| 3,477,506 | A | 11/1969 | Malone | |
| 3,489,220 | A * | 1/1970 | Kinley | 166/277 |
| 3,776,307 | A | 12/1973 | Young | |
| 5,083,608 | A | 1/1992 | Abdrakhmanov et al. | |
| 6,708,767 | B2 | 3/2004 | Harrall et al. | |
| 6,997,266 | B2 * | 2/2006 | Jackson et al. | 166/384 |
| 7,073,583 | B2 | 7/2006 | Anderton et al. | |
| 7,121,351 | B2 | 10/2006 | Luke et al. | |
| 7,475,723 | B2 | 1/2009 | Ring et al. | |
| 7,677,321 | B2 * | 3/2010 | Spray | 166/380 |
| 7,757,774 | B2 | 7/2010 | Ring | |
| 7,798,225 | B2 | 9/2010 | Giroux et al. | |
| 2004/0140093 | A1 | 7/2004 | Vloedman et al. | |
| 2005/0029812 | A1 | 2/2005 | Metcalfe | |
| 2005/0109517 | A1 | 5/2005 | Spray | |
| 2006/0225926 | A1 | 10/2006 | Madhavan et al. | |
| 2007/0107895 | A1 * | 5/2007 | Reavis et al. | 166/207 |
| 2009/0266560 | A1 * | 10/2009 | Ring et al. | 166/384 |
| 2010/0206585 | A1 * | 8/2010 | Watson | 166/384 |

FOREIGN PATENT DOCUMENTS

| | | |
|---|---|---|
| GB | 2 431 181 | 4/2007 |
| SU | 853089 | 8/1981 |
| WO | WO 2007/119052 | 10/2007 |

OTHER PUBLICATIONS

GB Search Report for Application No. GB1006741.1 dated Jun. 7, 2010.

GB Search Report for Application No. GB1006741.1 dated Oct. 1, 2010.

* cited by examiner

*Primary Examiner* — William P Neuder

(74) *Attorney, Agent, or Firm* — Patterson & Sheridan, L.L.P.

(57) ABSTRACT

A method and apparatus for expanding a tubular below a restriction in a wellbore. An expandable tubular may comprise a first end having a first wall thickness, a second end having a second wall thickness, and a middle section disposed between the first and second ends and having a third wall thickness that is less than the first and second wall thicknesses. The first and second ends may include one or more grooves disposed along a length of the ends. A method for expanding a tubular below a restriction in a wellbore may comprise running the tubular past the restriction, wherein the tubular comprises a first end and a second end, each end having a wall thickness greater than a wall thickness of a middle section disposed between the ends. The method may include expanding the tubular, wherein the first and second ends of the expanded tubular have outer diameters greater than the outer diameter of the middle section.

33 Claims, 11 Drawing Sheets

SYSTEM AND METHOD TO EXPAND TUBULARS BELOW RESTRICTIONS

BACKGROUND OF THE INVENTION

1. Field of the Invention

Embodiments of the invention generally relate to expanding tubulars in a wellbore. More particularly, embodiments of the invention relate to the expansion of tubulars below restrictions located in the wellbore. More particularly still, embodiments of the invention relate to an expandable tubular configured to be expanded below restrictions located in the wellbore.

2. Description of the Related Art

Oil & gas and other types of wells are completed by drilling a borehole in the earth and then lining the borehole with tubulars, such as liners, casing, or well pipe, to form a wellbore. Using apparatus known in the art, the tubulars are cemented into the wellbore by circulating cement into the annular area defined between the outer wall of the tubulars and the borehole. The combination of cement and tubulars strengthens the wellbore and facilitates the isolation of certain areas of the formation behind the tubulars for the production of hydrocarbons.

Recent developments in the oil and gas exploration and extraction industries have included using expandable bore liners and casing. Apparatus and methods are emerging that permit tubulars to be expanded in situ. The most common expansion methods include the use of a cone, an expander tool with radially extendable members, or a hydraulic pressure introduced inside of the tubular, also know as hydroforming.

During the formation or after the completion of a wellbore, occasionally, a leak may develop at some point along a length of a tubular that permits the loss of well fluids into the surrounding environment behind the tubular or permits the introduction of unwanted fluids into the tubular and the wellbore. It is therefore sometimes necessary to seal or patch a hole or other defect in the tubular to prevent the loss or introduction of fluids through the wellbore. By utilizing the expansion techniques discussed above, an expandable patch or liner may be located adjacent a leak in the tubular and expanded into sealed engagement with the inside wall of the tubular to prevent further leakage.

There are several problems, however, associated with the expansion of tubulars in general. First, expandable tubulars are limited to an expansion of about 10%-25% of their original diameter using existing expansion practices. Second, as the expandable tubulars are subjected to higher pressures in the wellbore, the minimum wall thickness requirements for the expandable tubulars to resist collapse or burst forces exerted by these pressures significantly increase. Finally, the running tools and the expansion tools themselves continue to face strict dimensional limitations as the inner diameter of the wellbore typically decreases with increasing depth of the wellbore.

These problems are exacerbated when the expansion of tubulars may be utilized to address a defect below a restriction in the wellbore. A restriction may include downhole packers, safety valves, tool landing profiles, lubricators, etc. As mentioned above, these restrictions pose additional severe constraints in running standard expandable tools into the wellbore. These restrictions also demand the use of high expansion ratio expandable liners, which require high expansion forces. Further, smaller diameter wellbores require smaller diameter expandable tubulars, which geometrically leads to larger expansion ratios. Techniques like hydroforming or expandable packers require high pressure surface pumps or hydraulic intensifiers along with the high expansion ratio expandable liners. When using hydraulic pressure to expand a tubular, due to the high pressure required, weaknesses in the tubular are exploited limiting the amount of expansion that can be achieved before the tubular ruptures.

Scab liners and inflatable packers have been traditionally used to deal with leaks in a tubular since they can pass through restrictions and then expand to seal the leak area. The disadvantages of these devices include unreliable sealing and a considerable reduction in the flow area, which affects production of the well. Longitudinally corrugated pipes have also been proposed but connecting such pipes still remains a challenge.

Therefore, there is a need for a new and improved method and apparatus for expanding tubulars in a wellbore. There is also a need for a new and improved method and apparatus for expanding tubulars below restrictions in the wellbore.

SUMMARY OF THE INVENTION

Embodiments of the invention generally relate to expanding tubulars in a wellbore. More particularly, embodiments of the invention relate to the expansion of tubulars below restrictions located in the wellbore. More particularly still, embodiments of the invention relate to an expandable tubular configured to be expanded below restrictions located in the wellbore.

In one embodiment, an expandable tubular comprises a first end having one or more grooves disposed along a length of the first end, a second end having one or more grooves disposed along a length of the second end, and a middle section coupled to the first and second ends. The middle section may include a wall thickness less than a wall thickness of the first and second ends.

In one embodiment, an expandable tubular comprises a first end having a first wall thickness and one or more grooves disposed along the length of the first end. The tubular further includes a second end having a second wall thickness and one or more grooves disposed along the length of the second end, wherein the one or more grooves on each end are separated by remaining portions of the first and second ends. The tubular further includes a middle section coupled to the first and second ends and having a third wall thickness, wherein the third wall thickness is less than the first and second wall thickness.

In one embodiment, a method for expanding tubulars below a restriction in a wellbore comprises running an expansion assembly beyond the restriction, wherein the expansion assembly comprises a tubular, wherein the ends of the tubular have a greater wall thickness than a section disposed between the ends of the tubular and an expansion tool coupled to the tubular. The method may include expanding the tubular using the expansion tool, wherein the ends of the expanded tubular have outer diameters greater than the section disposed between the ends of the expanded tubular.

In one embodiment, a method for expanding tubulars below a restriction in a wellbore comprises running an expansion assembly beyond the restriction. The expansion assembly comprises a tubular, wherein the ends of the tubular have a greater wall thickness than the middle section disposed between the ends of the tubular; an expansion tool coupled to the tubular; and a lifting device coupled to the expansion tool. The method further includes actuating the lifting device to move the expansion tool through the tubular and expanding the tubular, wherein the ends of the expanded tubular have outer diameters greater than the outer diameter of the middle section of the expanded tubular.

In one embodiment, an expandable tubular comprises a first end and a second end, wherein one or more grooves extends substantially along the length of the tubular from the first end to the second end to reduce an expansion force necessary to expand the tubular. The one or more grooves may include a helical shape. The one or more grooves may be disposed on the inner surfaces of the first end and the second end.

In one embodiment, a method for expanding a tubular below a restriction in a wellbore comprises running the tubular past the restriction, wherein the tubular comprises a first end, a second end, and one or more grooves that extend substantially along the length of the tubular from the first end to the second end and expanding the tubular, wherein the one or more grooves are configured to reduce an expansion force necessary to expand the tubular.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
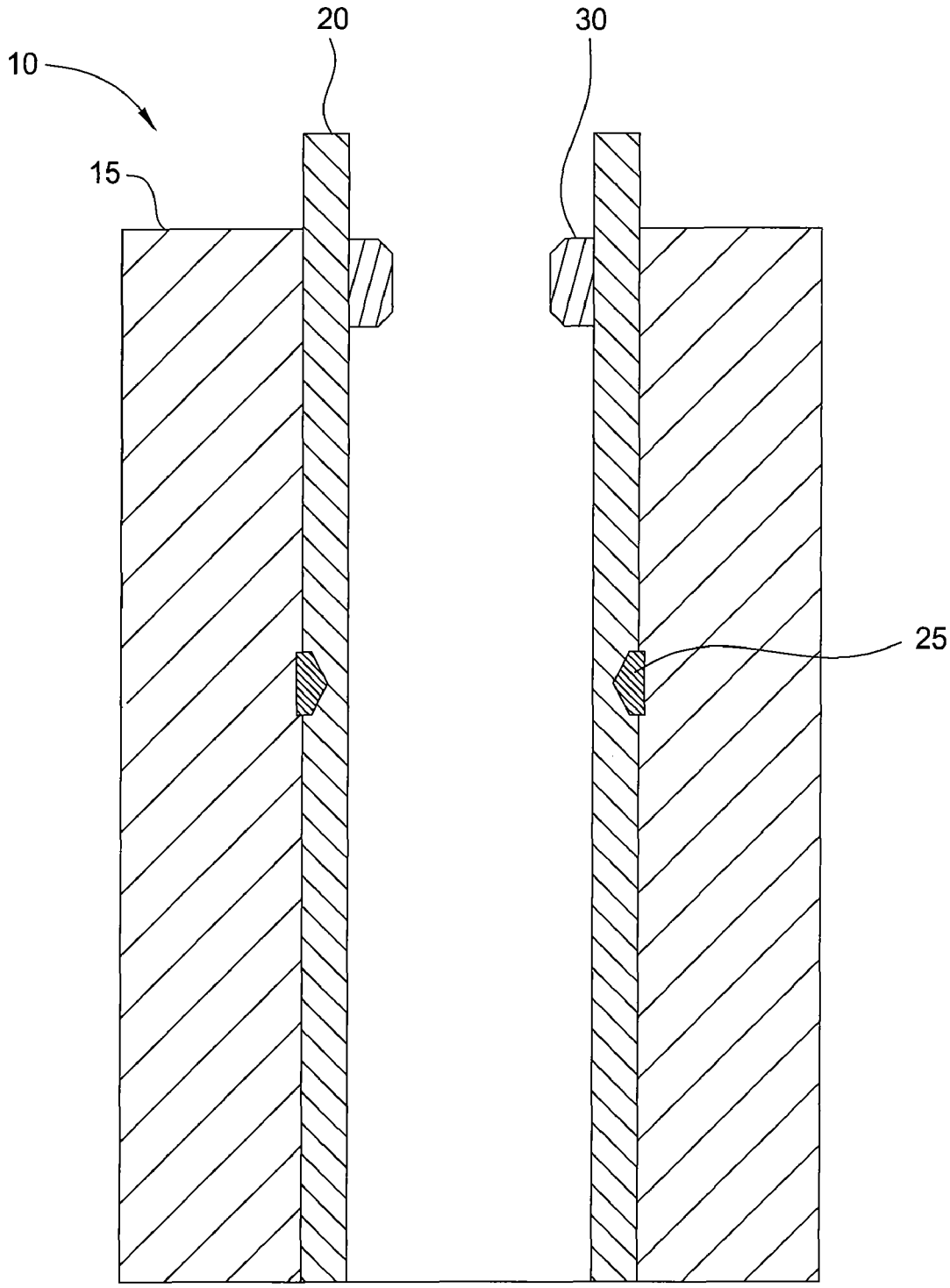
FIG. 1 is a sectional view of a wellbore having a defect located below a restriction in the wellbore.

FIG. 1 illustrates a wellbore 10 having a casing 20 disposed in an earthen formation 15. The casing 20 may be cemented in the formation 15 and may include multiple sections of casings coupled together to form the casing 20. Located along the length of the casing 20 is a defect 25, such as a leaking connection or a fracture in the wall of the casing 20. The defect 25 may permit the loss of a fluid, such as a liquid or a gas, into the surrounding earthen formation 15 or permit the introduction of unwanted fluids into the casing 20 of the wellbore 10. As a result, dangerous pressure fluctuations may occur during the formation or completion of the wellbore 10. The defect 25 is located below a restriction 30 in the wellbore 10. The restriction 30 may be a downhole packer, safety valve, landing profile, lubricator, tubular, or other obstruction which reduces the inner diameter of the wellbore 20 above the defect 25. The restriction 30 may include a much smaller inner diameter than the area having the defect 25.

In an alternative embodiment, the wellbore 10 may be uncased, such as an open hole disposed in the earthen formation 15. The defect 25 may be located along a wall of the open hole that can be treated using embodiments of the invention described herein. The defect 25 may represent a zone that permits the loss of a fluid, such as drilling mud, into the surrounding earthen formation 15 or permit the introduction of unwanted fluids into the wellbore 10.

Figure 2A:
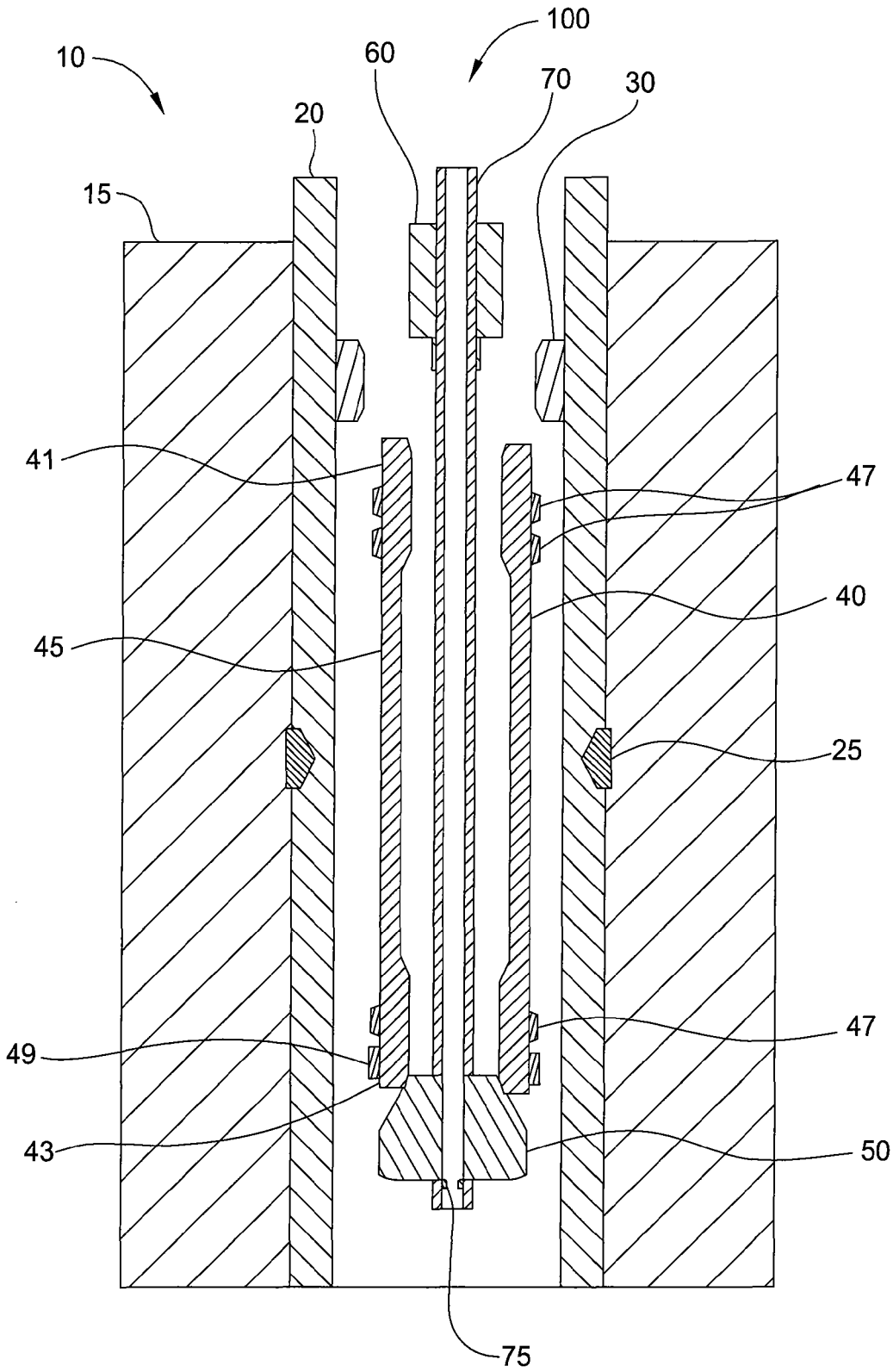
FIG. 2A is a sectional view of an expandable tubular of an expansion assembly attached to a work string and disposed in the wellbore.

FIG. 2A illustrates an expansion assembly 100 lowered into the wellbore 10. The expansion assembly 100 includes an expandable tubular 40, an expansion tool 50, and a lifting device 60, each disposed on a work string 70. The expansion assembly 100 may be run into the wellbore 10 on the work string 70 adjacent the defect 25. The expansion assembly 100 is configured to be lowered beyond the restriction 30. The expansion assembly 100 is configured to be lowered beyond the restriction 30 and adjacent the defect 25 in the wellbore 10, operated to expand the expandable tubular 40 into engagement with the wellbore 10, and removed from the wellbore 10 (leaving the expandable tubular 40 in the wellbore 10) during a single trip into the wellbore 10.

The expandable tubular 40 may be used to patch, support, and/or seal the defect 25 in the casing 20 or the wall of the formation 15 in an uncased open hole. The expandable tubular 40 may include a cylindrical body having a bore therethrough. The expandable tubular 40 may be formed from a metal alloy, such as steel. The expandable tubular 40 includes a first and second end 41 and 43, respectively, and a middle section 45, such that the middle section 45 has an inner diameter greater than the inner diameters of the first and second ends 41 and 43. The expandable tubular 40 has a greater wall thickness at the first and second ends 41 and 43 relative to the middle section of the expandable tubular 40, while maintaining a substantially uniform outer diameter along the entire length of the expandable tubular 40. The expandable tubular 40 may include a single tubular or multiple sections of tubulars coupled together. In an alternative embodiment, the first and second ends 41 and 43 may be separate pieces that are coupled to the middle section 45, such as by welding or threaded connections. In one embodiment, the expandable tubular 40 may include only the first and second ends 41 and 43 without having a middle section 45. In one embodiment, the expandable tubular 40 is about 6 feet to about 9 feet in length. In one embodiment, the expandable tubular 40 may include a solid wall. In one embodiment, the expandable tubular 40 may include one or more openings, such as holes or slots disposed in the wall of the expandable tubular 40. In one embodiment, the expandable tubular 40 may include a screen, such as an expandable sand screen. In one embodiment, the expandable tubular 40 may include one or more layers disposed on the expandable tubular 40.

One or more seal members 47 may be disposed on the outer surfaces of or partially disposed in a recess on the outer surfaces of the first and second ends 41 and 43 of the expandable tubular 40. The seal members 47 may be formed from a metallic material or a polymeric material, such as rubber or an elastomer. The seal members 47 are adapted to sealingly engage the inner surface of the casing 20 above and below the defect 25 upon expansion of the expandable tubular 40. The seal members 47 members may frictionally engage the casing, thereby holding the expandable tubular 40 axially within the casing. Alternatively or additionally, an anchor 49 may be disposed on the outer surface of or partially disposed in a recess on the outer surface of the first end 41 and/or second end 43, in order to secure the expandable tubular 40 to the casing 20 and support the expandable tubular 40 in the wellbore 10. Upon expansion of the expandable tubular 40, the anchor 49 is adapted to engage the inner surface of the casing 20. In one embodiment, the anchor 49 includes one or more gripping members for engaging the wellbore and securing the expandable tubular 40 in the wellbore. In one embodiment, the anchor 49 may include one or more gripping members, such wickers, slips, teeth, and/or gripping elements, such as carbide particles.

The expansion tool 50, such as a solid expansion cone or mandrel, is used to support the expandable tubular 40 adjacent the second end 43 of the expandable tubular 40. The expansion tool 50 may be in fluid communication with the work string 70, which is disposed through the expandable tubular 40. The expansion tool 50 is coupled to the lower end of the work string 70 and engages the lower end of the expandable tubular 40. The expansion tool 50 may be directed through the expandable tubular 40 to expand the expandable tubular 40 into engagement with the surrounding casing 20. In an alternative embodiment, the expansion tool 50 may include an expansion tool having radially expandable members, such as an expandable cone, expandable rollers, and/or having an inflatable bladder.

The lifting device 60 may be used to lift the expansion tool 50 through the expandable tubular 40. The lifting device 60 may be a hydraulic jack that is coupled to the work string 70 above the expandable tubular 40 and operable to lift the expansion tool 50 relative to the expandable tubular 40. In one embodiment, the lifting device is configured to lift the expansion tool 50 through the entire length of the expandable tubular 40 in a single stroke. In an alternative embodiment, the lifting device 60 is configured to lift the expansion tool 50 through a portion of the length of the expandable tubular 40 in a single stroke, and then may be reset to lift the expansion tool 50 again through the remaining length of the expandable tubular 40 in another stroke. In one embodiment, the lifting device 60 is configured to direct the expansion tool 50 through the entire length of the expandable tubular 40 using multiple actuations of the lifting device 60.

The work string 70 is configured to lower the entire expansion assembly 100 adjacent the defect 25 in a single trip into the wellbore 20. The work string 70 may include a tubular member having a flow bore therethrough with a seat 75 disposed at an end thereof. The work string 70 may be in fluid communication with the lifting device 60, the expansion tool 50, and/or the wellbore 10. The work string 70 may be used to provide hydraulic fluid to the lifting device 60 and/or the expansion tool 50 to operate these devices. Fluid communication between the work string 70 and the lifting device 60, expansion tool 50, and/or the wellbore 10 may be controlled using the seat 75 and a device such as a ball or dart that is directed through the work string 70 to engage and seal against the seat 75. In an alternative embodiment, the work string 70 may include one or more seats 75 disposed in the work string 70 to control fluid communication between the work string 70 and the devices coupled to the work string 70. In an alternative embodiment, the work string 70 may include a solid rod without a flowbore therethrough, and the expansion tool 50 may include a solid expansion cone.

In operation, the expansion assembly 100 is run into the wellbore 10 on the work string 70 adjacent the defect 25 in the casing 20 and below the restriction 30. The expansion assembly 100 is dimensioned to fit through one or more restrictions 30 located in the wellbore 10. The seals 47 disposed on the ends 41 and 43 of the expandable tubular 40, the anchor 49 disposed on the second end 43 of the expandable tubular 40, and the expansion cone 50 may each include outer diameters that are smaller than the inner diameter of the restriction 30 before expansion of the expandable tubular 40. The lifting device 60 may be located on the work string 70 above the restriction 30, while the expandable tubular 40 is located adjacent the defect 25. In an alternative embodiment, the lifting device 60 may also be dimensioned to be lowered beyond the restriction 30.

Figure 2B:
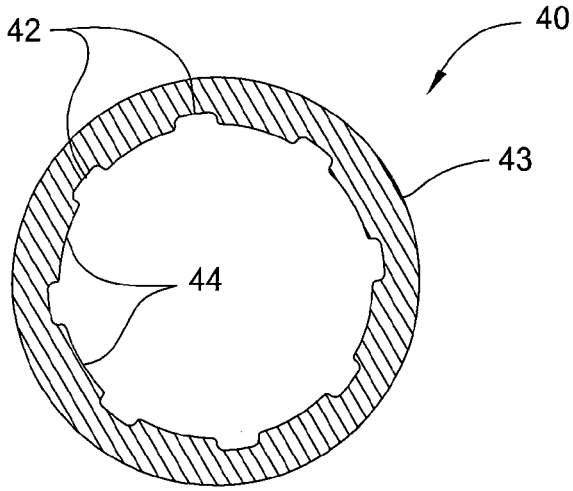
FIG. 2B is a cross sectional view at one end of the expandable tubular according to one embodiment of the invention.

FIG. 2B illustrates a cross sectional view at the second end 43 of the expandable tubular 40 according to one embodiment of the invention. It is important to note that the cross-section view of FIG. 2B may be the same cross sectional view at the first end 41 of the expandable tubular 40, and the embodiments described herein with respect to the second end 43 of the expandable tubular 40 are equally applicable to the first end 41. The inner diameter at the second end of the expandable tubular 40 may include one or more grooves 42, such as splines or flutes, located along the longitudinal length of the second end 43 of the expandable tubular 40. The grooves 42 are configured to reduce the higher expansion forces necessary to expand the thicker wall section at the second end 43 of the expandable tubular 40. The number, location, length, width, depth, and shape of the grooves 42 may be varied to adjust the expansion force necessary to expand the second end 43 of the expandable tubular 40. In one embodiment, the grooves 42 may be straight, spiraled, angled, vertical, or combinations thereof. In one embodiment, the grooves 42 may extend along the entire length of the expandable tubular 40. The grooves 42 may be disposed on the outer and/or inner surfaces of the expandable tubular 40. The grooves 42 may extend from the first end 41 to the second end 43 of the expandable tubular 40, including the middle section 45. For example, the grooved expandable tubular 40 may be of substantially uniform configuration throughout its length. The grooves 42 may also be configured to uniformly distribute the stresses developed in the expandable tubular 40 during expansion. In one embodiment, the grooves 42 are separated by the remaining portions 44 of the inner diameter of the expandable tubular 40. In one embodiment, the widths of the grooves 42 are about equal to the widths of the remaining portions 44 of the expandable tubular 40. In one embodiment, the wall thickness at the second end 43 of the expandable tubular 40 may range from about 0.20 inches to about 0.35 inches. In one embodiment, the wall thickness at the second end 43 of the expandable tubular 40 may range from about 0.10 inches to about 0.55 inches. In one embodiment, the wall thickness at the second end 43 of the expandable tubular 40 from the outer diameter of the expandable tubular 40 to the surface of the groove 42 may be about 0.20 inches. In one embodiment, the wall thickness at the second end 43 of the expandable tubular 40 from the outer diameter of the expandable tubular 40 to the surface of the remaining portion 44 may be about 0.35 inches. In alternative embodiments, the inner diameter of the grooves 42 may be less than, equal to, or greater than the inner diameter of the middle section 45 of the expandable tubular 40.

As shown in FIG. 2A, one or more seals 47 may be disposed on the outer surface of the second end 43. In one embodiment, a total thickness that includes the wall thickness at the second end 43 of the expandable tubular 40 and the thickness of the seal 47 disposed on the second end 43 may be about 0.35 inches. In one embodiment, a total thickness that includes the wall thickness at the second end 43 of the expandable tubular 40 and the thickness of the seal 47 disposed on the second end 43 may range between about 0.20 inches to about 0.35 inches.

Figure 2C:
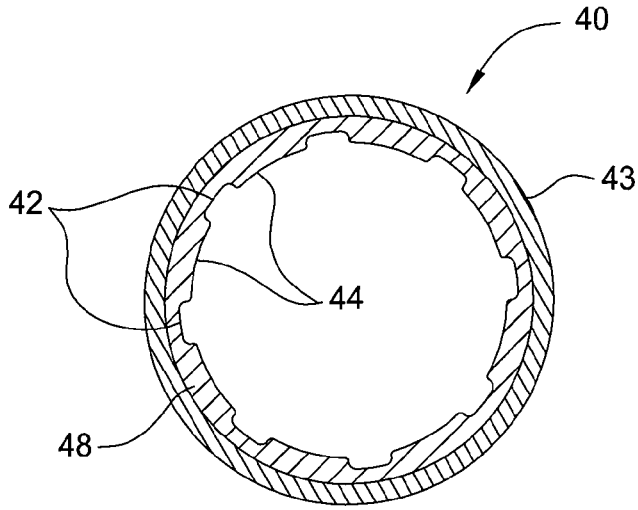
FIG. 2C is a cross sectional view at one end of the expandable tubular according to an alternative embodiment of the invention.

FIG. 2C is a cross sectional view at the second end 43 of the expandable tubular 40 according to an alternative embodiment of the invention. The second end 43 of the expandable tubular 43 may include a uniform outer diameter, a uniform inner diameter, and an expandable insert 48 disposed within the uniform inner diameter of the second end 43. The insert 48 includes a tubular member having a uniform outer diameter that is coupled to the inner diameter of the second end 43. The insert 48 has one or more grooves 42 separated by remaining portions 44 circumferentially disposed about the inner surface of the insert 48 and along the length of the second end 43. In one embodiment, the widths of the grooves 42 are about equal to the widths of the remaining portions 44 of the insert 48. In one embodiment, the wall thickness at the second end 43 of the expandable tubular 40 may range from about 0.20 inches to about 0.35 inches. In one embodiment, the wall thickness at the second end 43 of the expandable tubular 40 may range from about 0.10 inches to about 0.55 inches. In one embodiment, the wall thickness at the second end 43 of the expandable tubular 40 from the outer diameter of the expandable tubular 40 to the surface of the groove 42 of the insert 48 may be about 0.20 inches. In one embodiment, the wall thickness at the second end 43 of the expandable tubular 40 from the outer diameter of the expandable tubular 40 to the surface of the remaining portion 44 of the insert 48 may be about 0.35 inches. In alternative embodiments, the inner diameter of the grooves 42 of the insert may be less than, equal to, or greater than the inner diameter of the middle section 45 of the expandable tubular 40.

As shown in FIG. 2A, one or more seals 47 may be disposed on the outer surface of the second end 43. In one embodiment, a total thickness that includes the wall thickness of the insert 48, the wall thickness at the second end 43 of the expandable tubular 40, and the thickness of the seal 47 disposed on the second end 43 may be about 0.35 inches. In one embodiment, a total thickness that includes the wall thickness of the insert 48, the wall thickness at the second end 43 of the expandable tubular 40, and the thickness of the seal 47 disposed on the second end 43 may range between about 0.20 inches to about 0.35 inches.

The insert 48 may be coupled to the second end 43 using methods known by one of ordinary skill, such as by a threaded connection, a dovetail joint, a weld joint, or a shrink or interference fit. In an alternative embodiment, the insert 48 may be disposed in a groove machined in the inner circumference of the second end 43. In an alternative embodiment, the insert 48 may comprise a spring having expansion portions movably disposed on the spring that are configured to expand the expandable tubular 40 upon engagement with the expansion tool 50.

Figure 2D:
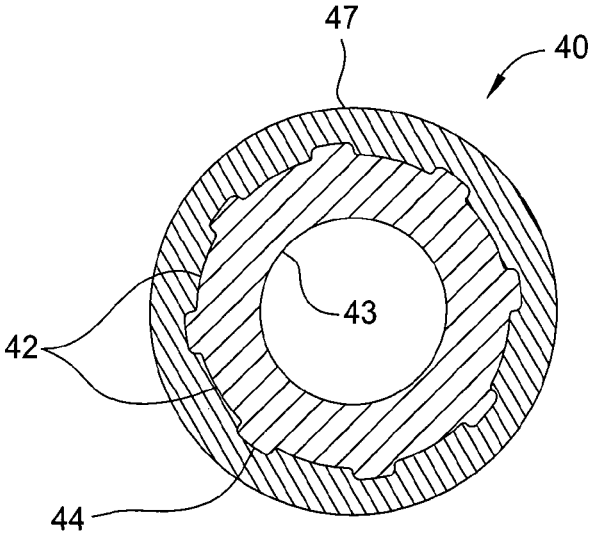
FIG. 2D is a cross sectional view at one end of the expandable tubular according to an alternative embodiment of the invention.

FIG. 2D a cross sectional view at the second end 43 of the expandable tubular 40 according to an alternative embodiment of the invention. The second end 43 includes a uniform inner diameter and an outer diameter having one or more grooves 42 separated by remaining portions 44 circumferentially disposed along the length of the second end 43. The one or more seals 47 coupled to the outer surface of the second end 43 may be disposed within the grooves 42 and surround the remaining portions 44. In one embodiment, the widths of the grooves 42 are about equal to the widths of the remaining portions 44 of the expandable tubular 40. In one embodiment, the wall thickness at the second end 43 of the expandable tubular 40 may range from about 0.20 inches to about 0.35 inches. In one embodiment, the wall thickness at the second end 43 of the expandable tubular 40 may range from about 0.10 inches to about 0.55 inches. In one embodiment, the wall thickness at the second end 43 of the expandable tubular 40 from the inner diameter of the expandable tubular 40 to the surface of the groove 42 may be about 0.20 inches. In one embodiment, the wall thickness at the second end 43 of the expandable tubular 40 from the inner diameter of the expandable tubular 40 to the surface of the remaining portion 44 may be about 0.35 inches. In alternative embodiments, the outer diameter of the grooves 42 of the insert may be less than, equal to, or greater than the outer diameter of the middle section 45 of the expandable tubular 40. In one embodiment, a total thickness that includes the wall thickness at the second end 43 of the expandable tubular 40 and the thickness of the seal 47 disposed on the second end 43 may be about 0.35 inches. In one embodiment, a total thickness that includes the wall thickness at the second end 43 of the expandable tubular 40 and the thickness of the seal 47 disposed on the second end 43 may range between about 0.20 inches to about 0.35 inches.

Figure 3:
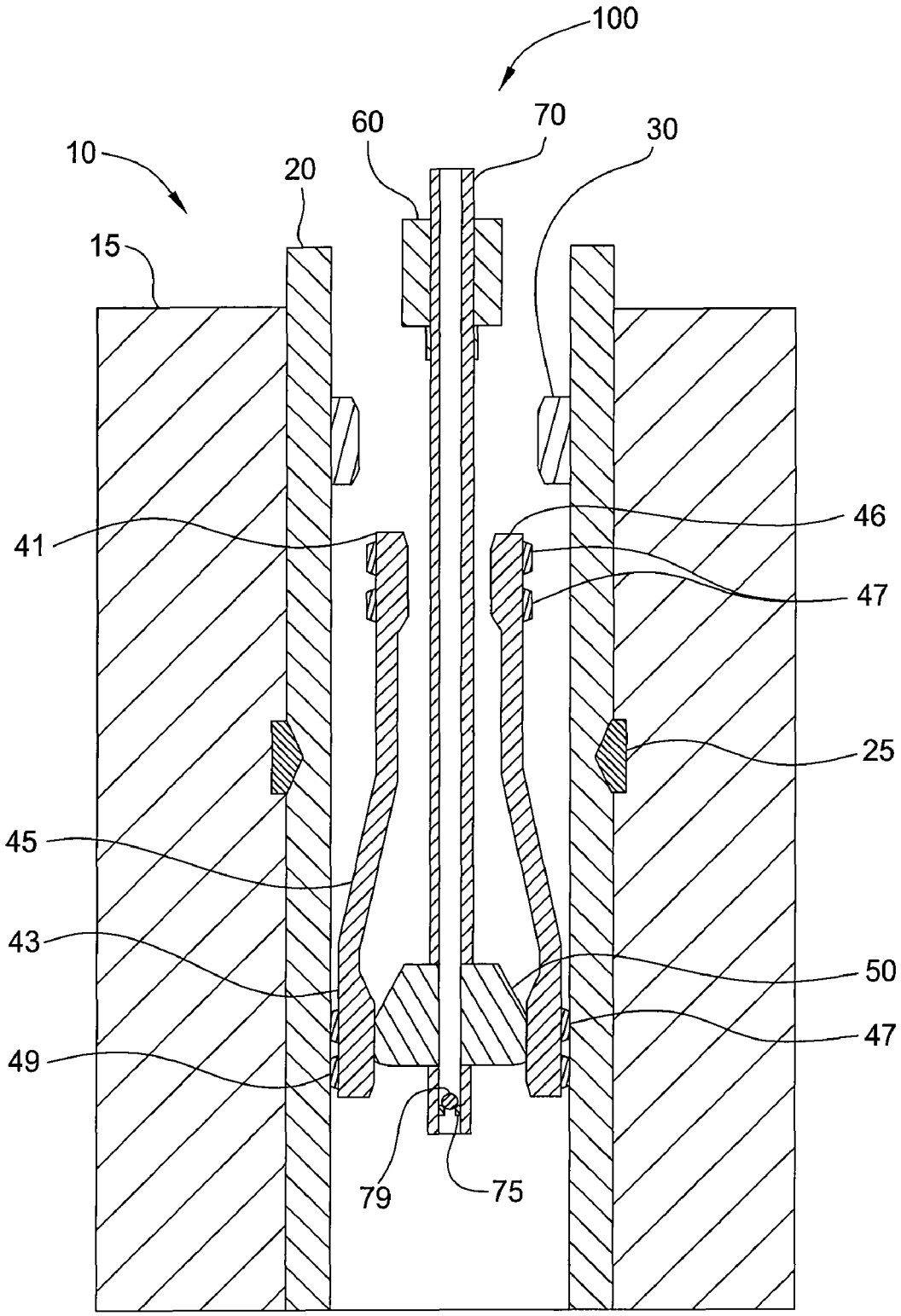
FIG. 3 is a sectional view of the expandable tubular during expansion.

FIG. 3 is a sectional view of the expandable tubular 40 during expansion with the expansion assembly. To begin expansion of the expandable tubular 40, the lifting device 60 may be actuated to direct the expansion tool 50 through the expandable tubular 40. In one embodiment, a ball 79 may be seated on the seat 75 disposed within the work string 70 to close fluid communication between the work string 70 and the wellbore 10. Fluid pressure may then be increased in the work string 70 to actuate the lifting device 60. The lifting device 60 may utilize the top surface 46 of the expandable tubular 40 as a reaction surface to move the expansion tool 50 relative to the expandable tubular 40. The lifting device 60 may engage the top surface 46 of the expandable tubular 40, lift the work string 70, and thereby lift the expansion tool 50 through the expandable tubular 40 and expand the expandable tubular 40. The expansion tool 50 expands the second end 43 of the expandable tubular 40. Upon expansion, the seals 47 and the anchor 49 engage the inner surface of the casing 20. The seals 47 sealingly engage the inner surface of the casing 20 below the defect 25. The anchor 49 engages the inner surface of the casing 20 and is operable to support the expandable tubular 40 in the wellbore 10. In one embodiment, the lifting device 60 may include one or more selectively extendable gripping members, such as slips, for securing the lifting device 60 in the wellbore to function as a reaction point against which the lifting device 60 may move the expansion tool 50 relative to the expandable tubular 40 to expand the expandable tubular 40.

Figure 4:
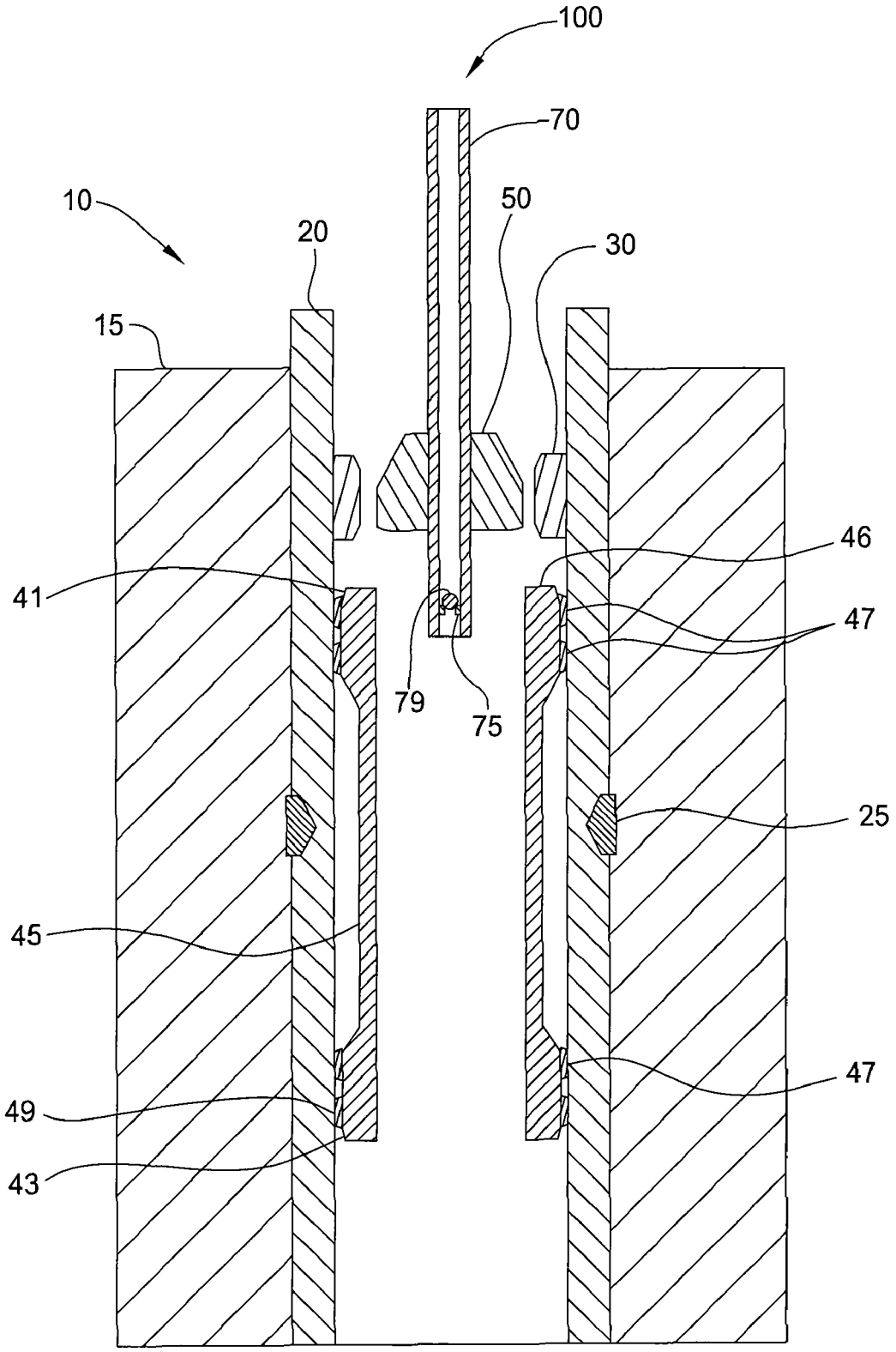
FIG. 4 is a sectional view of the expandable tubular after expansion of the expandable tubular in the wellbore.
Figure 5A:
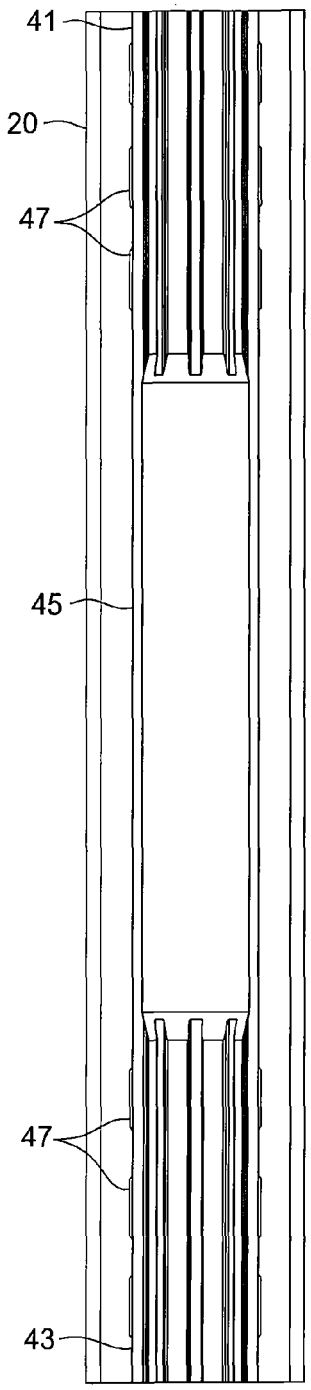
FIG. 5A is a sectional view of the expandable tubular disposed in a casing before expansion.
Figure 5B:
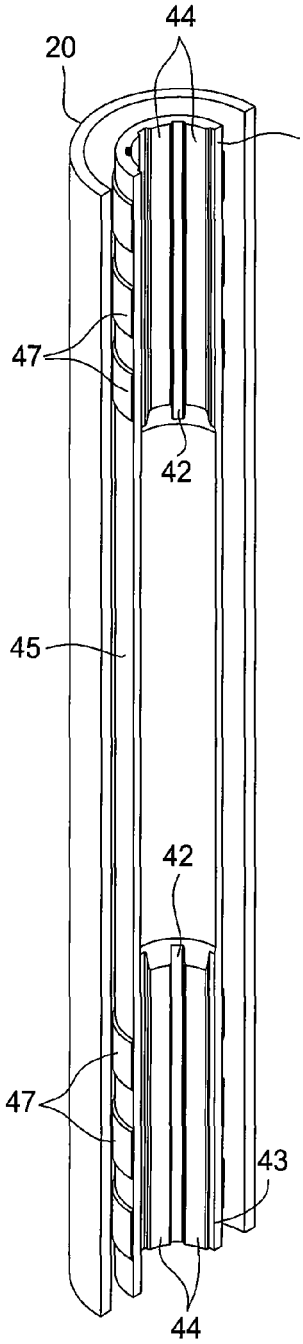
FIG. 5B is an isometric view of the expandable tubular disposed in the casing before expansion.
Figure 5C:
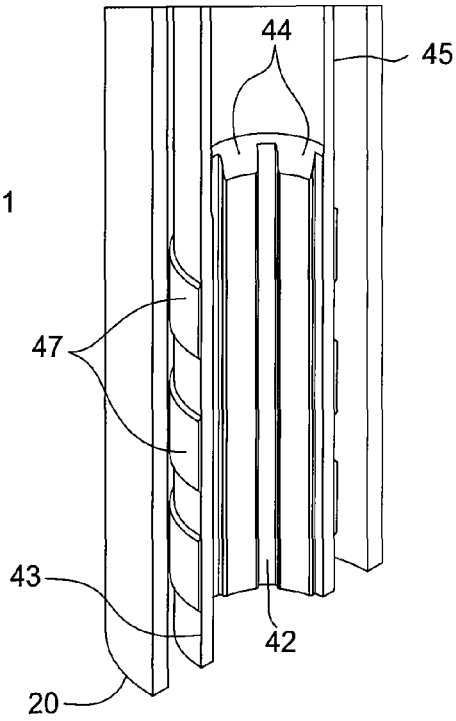
FIG. 5C is an isometric view of one end of the expandable tubular disposed in the casing before expansion.
Figure 5D:
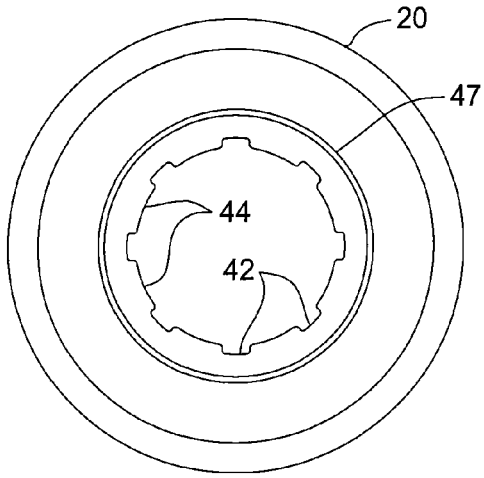
FIG. 5D is a cross sectional view of one end of the expandable tubular disposed in the casing before expansion.
Figure 6A:
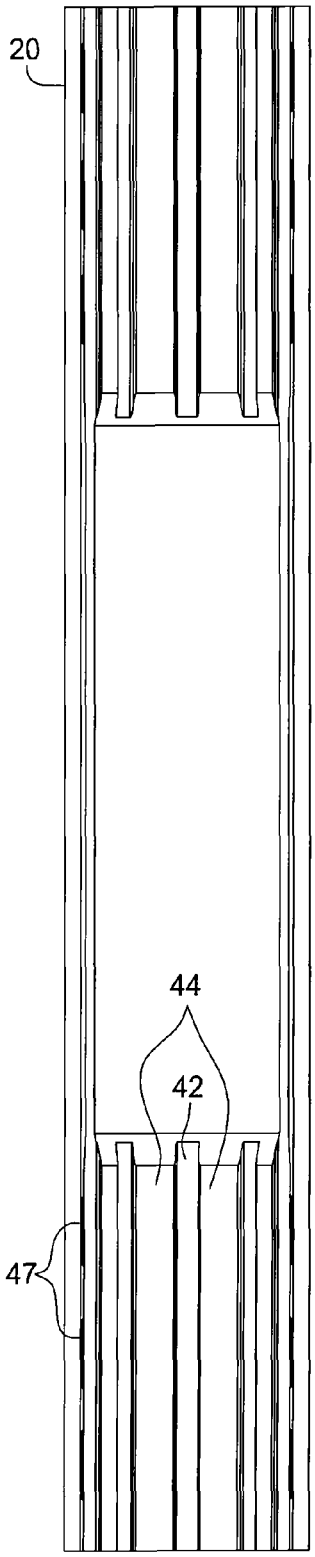
FIG. 6A is a sectional view of the expandable tubular disposed in a casing after expansion.
Figure 6B:
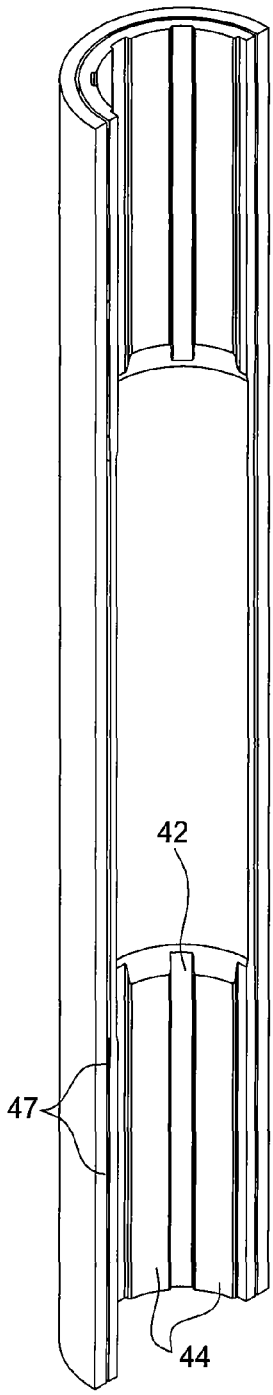
FIG. 6B is an isometric view of the expandable tubular disposed in the casing after expansion.
Figure 6C:
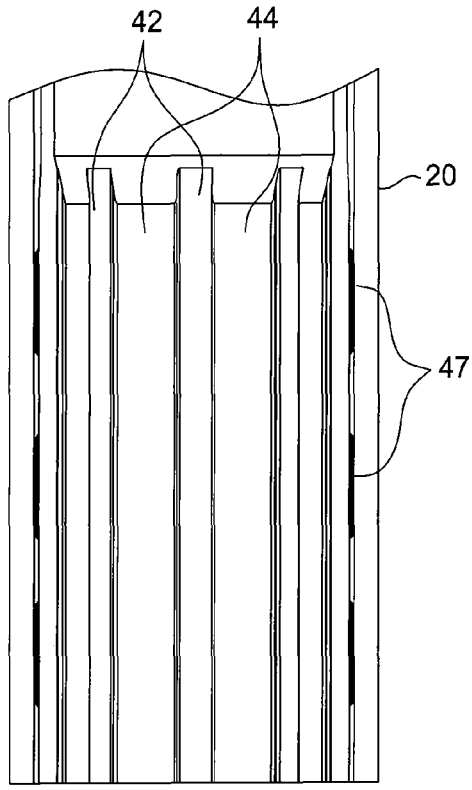
FIG. 6C is an isometric view of one end of the expandable tubular disposed in the casing after expansion.
Figure 6D:
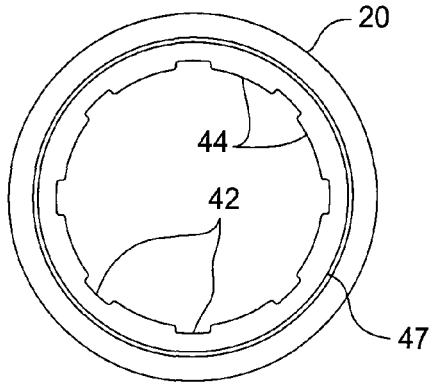
FIG. 6D is a cross sectional view of one end of the expandable tubular disposed in the casing after expansion.
Figure 7A:
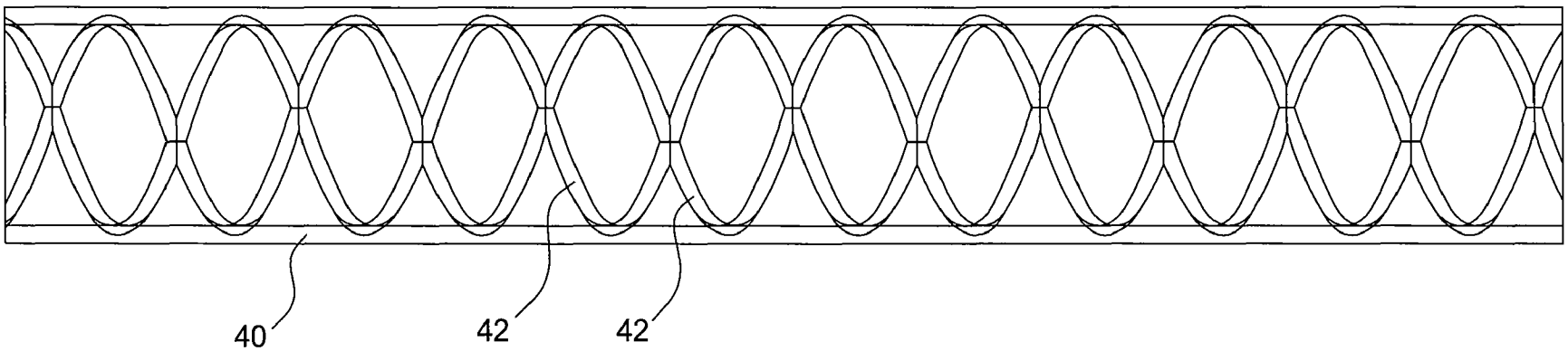
FIG. 7A is a sectional view of the expandable tubular according to one embodiment of the invention.
Figure 7B:
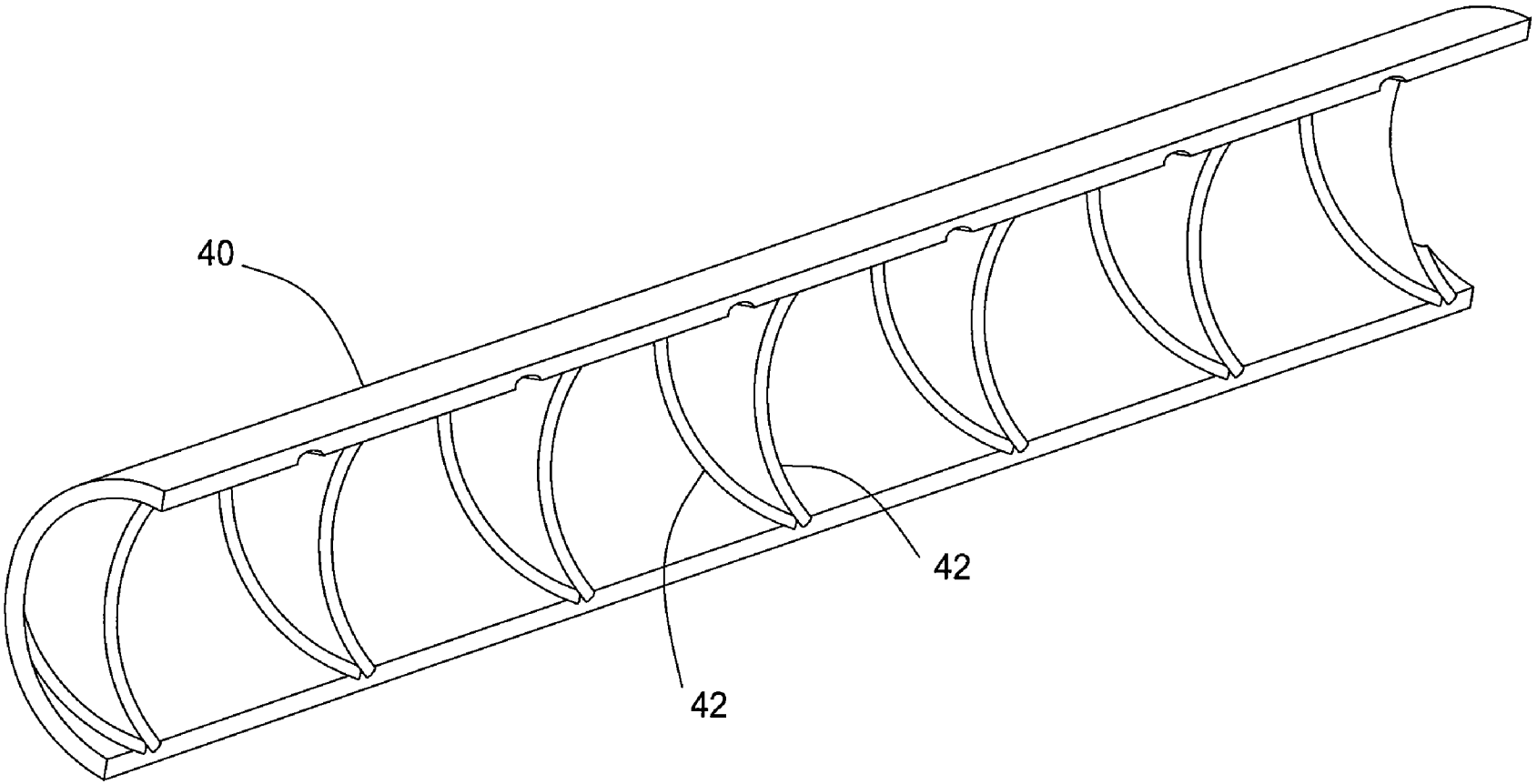
FIG. 7B is an isometric view of the expandable tubular according to one embodiment of the invention.
Figure 8A:
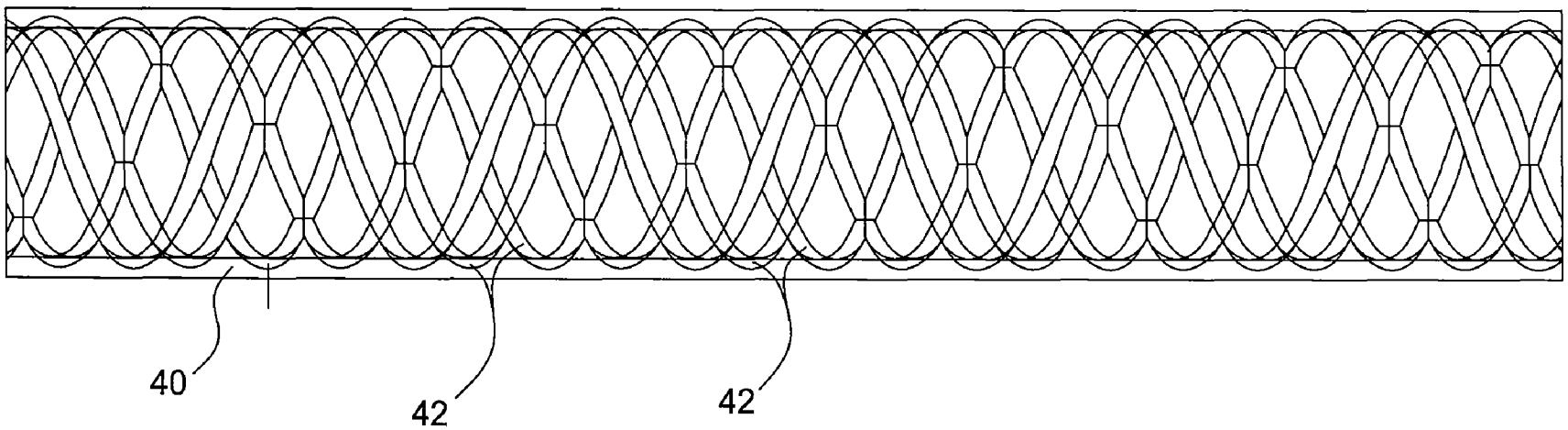
FIG. 8A is a sectional view of the expandable tubular according to one embodiment of the invention.
Figure 8B:
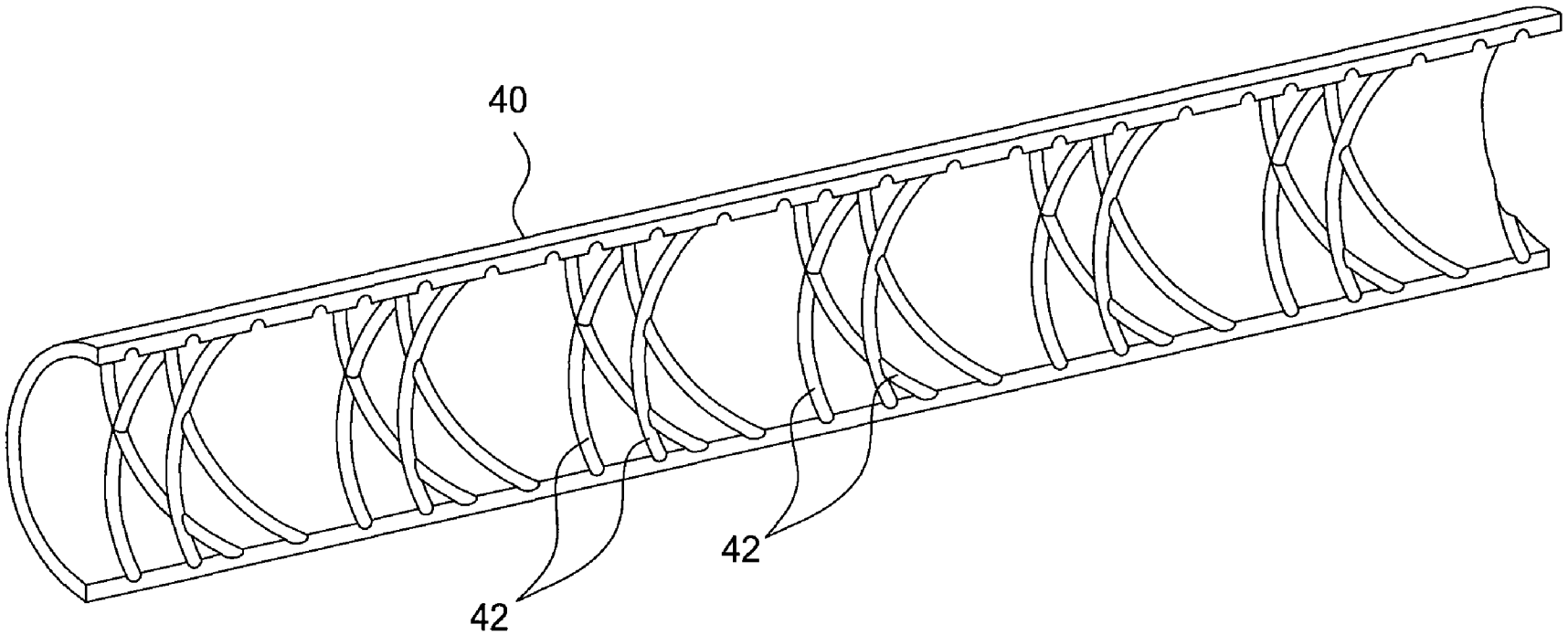
FIG. 8B is an isometric view of the expandable tubular according to one embodiment of the invention.

FIG. 4 illustrates the expandable tubular 40 after expansion. As described above, the lifting device 60 may be configured to direct the expansion tool 50 through the entire length of the expandable tubular 40 in a single actuation, thereby expanding the expandable tubular 40 in a single actuation. In an alternative embodiment, the lifting device 60 may be direct the expansion tool 50 through a portion of the length of the expandable tubular 40 in a single actuation. Initially, the top surface 46 of the expandable tubular 40 may be used as a reaction surface against which the lifting device 60 may engage to lift the expansion tool 50 relative to the expandable tubular 40. Upon expansion of the second end 43 of the expandable tubular 40, the anchor 49 may secure and support the expandable tubular 40 in the wellbore 10. The lifting device 60 on the work string 70 may be reset while the anchor 49 supports the expandable tubular 40 in the wellbore 10. Subsequent actuation (s) of the lifting device 60 may utilize the engaged anchor 49 as a reaction point against which the lifting device 60 may move the expansion tool 50 relative to the expandable tubular 40 to expand the expandable tubular 40. In an alternative embodiment, after initial expansion of the expandable tubular 40 using the lifting device 60 and engagement of the anchor 49 to the casing 20, the expansion tool 50 may be pulled through the remaining portion of the expandable tubular 40 by applying a pull force on the work string 70 from the surface of the wellbore 10 to expand the remaining portion of the expandable tubular 40. Upon expansion of the first end 43 of the expandable tubular 40, the seals 47 may sealingly engage the inner surface of the casing 20 above the defect 25. The seals 47 effectively seal off the defect 25 and prevent fluid communication between the earthen formation 15 and the inside of the casing 20 via the defect 25. After expansion of the expandable tubular 40, the lifting device 60, the expansion tool 50, and the work string 70 may be raised through the restriction 30 and removed from the wellbore 10.

In an alternative embodiment, the expansion assembly 100 may be configured to expand the expandable tubular 40 in a top-down approach. The expansion tool 50 may be initially coupled to the work string 70 adjacent the first end 41 of the expandable tubular 40. The first end 41 of the expandable tubular 40 may include the anchor 49 to secure the expandable tubular 40 in the wellbore upon expansion of the first end 41. Actuation of the expansion tool 50 may direct the expansion tool 50 through the expandable tubular 40 from the first end 41 to the second end 43 of the expandable tubular 40. After expansion, the expansion tool 50 and the work string 70 may be removed from the wellbore 10 through the expanded expandable tubular 40 and the restriction 30.

As shown in FIG. 4, since the first and second ends 41 and 43 of the expandable tubular 40 have thicker wall sections relative to the middle section 45, the expansion of the first and second ends 41 and 43 result in these ends having larger outer diameters compared to middle section 45. The thicker wall sections allow the expansion assembly 100 to pass through the restriction 30 while expanding to a large outer diameter without adversely affecting the expandable tubular 40 and the expansion forces necessary to expand the expandable tubular 40.

FIGS. 5A-5D illustrate the expandable tubular 40 disposed in a casing 20 before expansion. FIGS. 6A-6D illustrate the expandable tubular 40 disposed in a casing 20 after expansion. As described above, the expandable tubular 40 includes first and second ends 41 and 43 having thicker wall sections than the middle section 45 of the expandable tubular 40. The expandable tubular 40 includes one or more grooves 42 separated by remaining portions 44 circumferentially disposed along the inner surface of the expandable tubular at the first and second ends 41 and 43. One or more seals 47 are disposed on the outer surface of the first and second ends 41 and 43 of the expandable tubular 40 to sealingly engage the casing 20 upon expansion of the expandable tubular 40. The first and/or second ends 41 and 43 may also include one or more anchors 49 as described above.

FIGS. 7A-B and 8A-B illustrate alternative embodiments of the expandable tubular 40. The expandable tubular 40 may include a substantially uniform outer diameter and inner diameter along the longitudinal length of the expandable tubular 40. The inner surface of the expandable tubular 40 may include one or more helical grooves 42 disposed along the longitudinal length of the expandable tubular 40. The helical grooves 42 may help reduce the expansion forces necessary to expand the expandable tubular 40. In one embodiment, the expandable tubular 40 may include two helical grooves formed in the inner surface of the expandable tubular 40 and that extend the longitudinal length of the expandable tubular 40. In one embodiment, the expandable tubular 40 may include four helical grooves formed in the inner surface of the expandable tubular 40 and that extend the longitudinal length of the expandable tubular 40. A helical groove 42 may continuously extend from one end of the expandable tubular 40 to the opposite end of the expandable tubular 40. The helical grooves 42 may intersect with one or more other helical grooves 42. The number and pitch of the one or more helical grooves 42 may be vary. The expandable tubular 40 may include one or more seals and/or anchors as described above for engagement with the wellbore. The substantially uniform outer and inner diameters may assist in providing a better seal and uniform profile after expansion of the expandable tubular 40.

While the foregoing is directed to embodiments of the present invention, other and further embodiments of the invention may be devised without departing from the basic scope thereof, and the scope thereof is determined by the claims that follow.

The invention claimed is:

1. An expandable tubular, comprising:

a first end having one or more grooves disposed along a length of the first end;

a second end having one or more grooves disposed along a length of the second end; and a middle section coupled to the first and second ends, wherein the middle section includes a wall thickness less than a wall thickness of the first and second ends.

2. The tubular of claim 1, further comprising one or more seals disposed on the outer surface of the first and second ends.

3. The tubular of claim 2, wherein the wall thickness of the first and second ends includes a thickness of the one or more seals.

4. The tubular of claim 1, wherein the one or more grooves are disposed on the inner surfaces of the first and second ends.

5. The tubular of claim 1, wherein the one or more grooves are disposed on the outer surfaces of the first and second ends.

6. The tubular of claim 1, wherein the one or more grooves disposed on the first end extend along the length of the middle section to the one or more grooves disposed on the second end.

7. The tubular of claim 1, wherein the one or more grooves on the first and second ends are helical in shape.

8. The tubular of claim 1, further comprising a first insert and a second insert coupled to the first and second ends, respectively.

9. The tubular of claim 8, wherein the one or more grooves of the first and second ends are disposed on the first and second inserts, respectively.

10. The tubular of claim 1, wherein the middle section has an inner diameter greater than an inner diameter of the first and second ends prior to expansion of the tubular.

11. The tubular of claim 1, wherein the tubular has a uniform outer diameter prior to expansion of the tubular.

12. The tubular of claim 1, wherein the first end, the second end, and the middle section each have the same outer diameter prior to expansion of the tubular.

13. The tubular of claim 1, wherein the tubular has a uniform inner diameter after expansion of the tubular.

14. The tubular of claim 1, wherein the first end, the second end, and the middle section each have the same inner diameter after expansion of the tubular.

15. The tubular of claim 1, wherein the middle section has an outer diameter less than the outer diameters of the first end and the second end after expansion of the tubular.

16. A method for expanding tubulars below a restriction in a wellbore, comprising:

running an expansion assembly beyond the restriction, wherein the expansion assembly comprises:

a tubular, wherein the ends of the tubular have a greater wall thickness than a section disposed between the ends of the tubular; and an expansion tool coupled to the tubular; and expanding the tubular using the expansion tool, wherein the ends of the expanded tubular have outer diameters greater than the section disposed between the ends of the expanded tubular.

17. The method of claim 16, wherein the expansion tool is a solid expansion cone.

18. The method of claim 16, further comprising moving the expansion tool using a lifting device coupled to the expansion tool.

19. The method of claim 16, wherein the tubular comprises one or more seals disposed on the outer surfaces of the ends of the tubular.

20. The method of claim 19, further comprising sealing off a defect in the wellbore using the one or more seals.

21. The method of claim 19, further comprising expanding a first end of the tubular into sealing contact with a wall of the wellbore and securing the first end of the tubular to the wall of the wellbore.

22. The method of claim 16, further comprising using a top surface of the tubular as a reaction surface to move the expansion tool relative to the tubular.

23. The method of claim 16, wherein at least the ends of the tubular include one or more grooves disposed along the surfaces thereof.

24. The method of claim 23, wherein the one or more grooves disposed along the surfaces include at least one of a linear shape and a helical shape.

25. An expandable tubular, comprising:

a first end;

a second end having one or more grooves disposed along a length of the second end; and a middle portion disposed between the first and second ends, wherein the middle section includes a wall thickness less than a wall thickness of at least one of the first and second ends.

26. The tubular of claim 25, further comprising an insert coupled to the second end.

27. The tubular of claim 26, wherein the wall thickness of the second end includes a thickness of the insert.

28. The tubular of claim 26, wherein the one or more grooves of the second end are formed in a surface of the insert.

29. The tubular of claim 25, wherein the middle portion has an inner diameter greater than an inner diameter of the first and second ends prior to expansion of the tubular.

30. The tubular of claim 25, wherein the one or more grooves are disposed on an inner surface of the second end.

31. The tubular of claim 25, wherein the one or more grooves are disposed on an outer surface of the second end.

32. The tubular of claim 25, further comprising one or more seals disposed on an outer surface of the first and second ends.

33. The tubular of claim 31, wherein the wall thickness of the first and second ends includes a thickness of the one or more seals.

* * * * *